US006821175B1

(12) United States Patent
Tuck et al.

(10) Patent No.: US 6,821,175 B1
(45) Date of Patent: Nov. 23, 2004

(54) METHOD OF MANUFACTURING A FIELD ELECTRON EMISSION CATHODE HAVING AT LEAST ONE CATHODE ELECTRODE

(75) Inventors: Richard Allan Tuck, Slough (GB); Peter Graham Adpar Jones, High Wycombe (GB)

(73) Assignee: Printable Fields Emitters Limited, Hartlepool (GB)

( * ) Notice: Subject to any disclaimer, the term of this patent is extended or adjusted under 35 U.S.C. 154(b) by 0 days.

(21) Appl. No.: 09/530,023

(22) PCT Filed: Oct. 22, 1998

(86) PCT No.: PCT/GB98/03142

§ 371 (c)(1),
(2), (4) Date: Apr. 21, 2000

(87) PCT Pub. No.: WO99/21207

PCT Pub. Date: Apr. 29, 1999

(30) Foreign Application Priority Data

Oct. 22, 1997 (GB) ..... 9722258

(51) Int. Cl.[7] ..... H01J 9/00
(52) U.S. Cl. ..... 445/24; 445/50
(58) Field of Search ..... 445/24, 25, 50, 445/51

(56) References Cited

U.S. PATENT DOCUMENTS 5,628,663 A * 5/1997 Potter ..... 445/50
5,634,585 A * 6/1997 Stansbury ..... 445/24
5,696,385 A * 12/1997 Song et al. ..... 313/309

* cited by examiner

*Primary Examiner*—Joseph Williams
(74) *Attorney, Agent, or Firm*—Barnes & Thornburg, LLP

(57) ABSTRACT

A field electron emission cathode is manufactured by depositing on an insulating substrate 300, by low resolution means, a sequence of a first conducting layer 301, a field emitting layer 302 and a second conducting layer 303 to form at least one cathode electrode. There is then deposited on the cathode electrode by low resolution means, a sequence of an insulating layer 304 and a third conducting layer 305, to form at least one gate electrode. The structure thus formed is then coated with a photoresist layer 306. The photoresist layer 306 is then exposed by high resolution means to form at least one group of emitting cells, the or each such group being located in an area of overlap between a cathode electrode and gate electrode. To complete the cells, the conducting and insulating layers 305, 304, 303 are etched sequentially to expose the field emitting layer 302 in the cells, and remaining areas of the photoresist layer 306 are removed. Thus, field emitting materials and devices can be manufactured using relatively low cost techniques.

10 Claims, 13 Drawing Sheets

METHOD OF MANUFACTURING A FIELD ELECTRON EMISSION CATHODE HAVING AT LEAST ONE CATHODE ELECTRODE

This invention relates to field emission devices and in particular to methods of manufacturing addressable field electron emission cathodes. Preferred embodiments of the present invention aim to provide low manufacturing cost methods of fabricating multi-electrode control and focusing structures.

It has become clear to those skilled in the art that the keys to practical field emission devices, particularly displays, are arrangements that permit the control of the emitted current with low voltages. The majority of the art in this field relates to tip-based emitters—that is, structures that utilise atomically sharp micro-tips as the field emitting source.

There is considerable prior art relating to tip-based emitters. The main objective of workers in the art has been to place an electrode with an aperture (the gate) less than 1 $\mu$m away from each single emitting tip, so that the required high fields can by achieved using applied potentials of 100V or less—these emitters are termed gated arrays. The first practical realisation of this was described by C A Spindt, working at Stanford Research Institute in California (*J.Appl.Phys.* 39, 7, pp3504–3505, (1968)). Spindt's arrays used molybdenum emitting tips which were produced, using a self masking technique, by vacuum evaporation of metal into cylindrical depressions in a $SiO^2$ layer on a Si substrate. Many variants and improvements on the basic Spindt technology are described in the scientific and patent literature.

An alternative important approach is the creation of gated arrays using silicon micro-engineering. Field electron emission displays utilising this technology are being manufactured at the present time, with interest by many organisations world-wide. Again many variants have been described.

A major problem with all tip-based emitting systems is their vulnerability to damage by ion bombardment, ohmic heating at high currents and the catastrophic damage produced by electrical breakdown in the device. Making large area devices is both difficult and costly. Furthermore, in order to get low control voltages, the basic emitting element, consisting of a tip and its associated gate aperture, must be approximately one $\mu$m (one micron) or less in diameter. The creation of such structures requires semiconductor-type fabrication technology with its high associated cost structure. Moreover, when large areas are required, expensive and slow step and repeat equipment must be used.

In about 1985, it was discovered that thin films of diamond could be grown on heated substrates from a hydrogen-methane atmosphere, to provide broad area field emitters.

In 1988 S Bajic and R V Latham, (*Journal of Physics D Applied Physics*, vol. 21 200–204 (1988)), described a low-cost composite that created a high density of metal-insulator-metal-insulator-vacuum (MIMIV) emitting sites. The composite had conducting particles dispersed in an epoxy resin. The coating was applied to the surface by standard spin coating techniques.

Much later (1995) Tuck, Taylor and Latham (GB 2304989) improved the above MIMV emitter by replacing the epoxy resin with an inorganic insulator that both improved stability and enabled it to be operated in sealed off vacuum devices.

The best examples of such broad-area emitters can produce usable electric currents at fields less than 10 V$\mu$m$^{-1}$. In the context of this specification, a broad-area field emitter is any material that by virtue of its composition, microstructure, work function or other property emits useable electronic currents at macroscopic electrical fields that might be reasonably generated at a planar or near-planar surface—that is, without the use of atomically sharp micro-tips as emitting sites.

Electron optical analysis shows that the feature size required to control a broad-area emitter is nearly an order of magnitude larger than for a tip-based system. Zhu et al (U.S. Pat. No. 5,283,501) describes such structures with diamond-based emitters. Moyer (U.S. Pat. No. 5,473,218) claims an electron optical improvement in which a conducting layer sits upon the broad-area emitter to both prevent emission into the gate insulator and focus electrons through the gate aperture. The concept of such structures was not new and is electronoptically equivalent to arrangements that had been used in thermionic devices for many decades. For example Winsor (U.S. Pat. No. 3,500,110) described a shadow grid at cathode potential to prevent unwanted electrons intercepting a grid set at a potential positive with respect to the cathode. Somewhat later Miram (U.S. Pat. No. 4,096,406) improved upon this to produce a bonded grid structure in which the shadow grid and control grid are separated by a solid insulator and placed in contact with the cathode. Moyer's arrangement simply replaced the thermionic cathode in Miram's structure with an equivalent broad-area field emitter. However, such structures are useful, with the major challenge being methods of constructing them at low cost and over large areas. It is in this area that preferred embodiments of the present invention make a contribution to the art.

In Hoole A C F et al "Directly patterned low voltage planar tungsten lateral field emission structures", *Journal of Vacuum Science and Technology*: Part B, Vol 11, No. 6, 1 Nov. 1993, Pages 2574–2578, XP000423379, there is disclosed a combination of low-resolution and high-resolution exposure steps. This is to overcome a problem with a high resolution device having an insufficiently small field of view. No attention or teaching is given as to the low cost fabrication of field emission cathodes having gate electrodes formed over cathode electrodes.

EP 0 795 622 A1 discloses a method for forming a field emission device. This involves vacuum deposition and is concerned with controlled ion bombardment of a precursor of a multi-phase material to form layers of different properties. It does not address the matter of forming field emission devices at low cost, and in particular, provides no teaching as to how desired accuracy of alignment can be achieved at low cost. Amongst many other things, it shows a fairly typical field emitter arrangement in which a structure that may be regarded as a gate electrode, comprising an insulating layer and a conducting layer, is disposed over a structure that may be regarded as a cathode electrode, comprising a field emitting layer between two conducting layers.

Preferred embodiments of the present invention aim to provide cost-effective field emitting structures and devices that utilise broad-area emitters. The emitter structures may be used in devices that include: field electron emission display panels; high power pulse devices such as electron MASERS and gyrotrons; crossed-field microwave tubes such as CFAs; linear beam tubes such as klystrons; flash x-ray tubes; triggered spark gaps and related devices; broad area x-ray sources for sterilisation; vacuum gauges; ion thrusters for space vehicles; particle accelerators; lamps; ozonisers; and plasma reactors.

According to one aspect of the present invention, there is provided a method of manufacturing a field electron emission cathode having at least one cathode electrode which comprises a field emitting layer between first and second conducting layers, and at least one gate electrode which overlies said cathode electrode and comprises an insulating layer and a third conducting layer, wherein said method comprises the steps of:

a. depositing on an insulating substrate to form by low resolution means, a sequence of said first conducting layer, field emitting layer and second conducting layer to form said cathode electrode;

b. depositing on said cathode electrode to form by low resolution means, a sequence of said insulating layer and third conducting layer, to form said gate electrode;

c. coating the structure thus formed with a photoresist layer;

d. exposing said photoresist layer by high resolution means to form at least one group of emitting cells, the or each said group being located in an area of overlap between one said cathode electrode and one said gate electrode;

e. etching sequentially said third conducting layer, said insulating layer and said second conducting layer to expose said field emitting layer in said cells; and f. removing remaining areas of said photoresist layer.

Preferably, said cathode is a cathode array, said cathode electrode and said gate electrode comprise respectively cathode addressing tracks and gate addressing tracks, which tracks are arranged in addressable rows and columns, and step d. includes forming a pattern of said groups of emitting cells.

Preferably, at least one of or all of said cathode addressing tracks address(es) a plurality of rows or columns of cells.

Each row and/or column can be thin or wide, to take in as few or as many cells as desired, depending upon the application of the cathode.

Preferably, said steps of exposing and etching include the formation of fiducial marks on the cathode array, to facilitate the subsequent alignment of the array with an anode or other component after manufacture of the array.

A method as above may comprise the step of forming at least one of said conducting layers by application of a liquid bright metal or by electroless plating.

A method as above may comprise the step of forming at least one of said conducting layers by a means other than vacuum evaporation or sputtering.

Preferably, said field emitting layer comprises a layer of broad area field emitter material.

A method as above may comprise the further steps of depositing sequentially a second insulating layer and fourth conducting layer onto the cathode after completion of steps a. to f., to form a focus grid.

The invention extends to a field electron emission cathode which has been manufactured by a method according to any of the preceding aspects of the invention.

According to another aspect of the present invention, there is provided a field emission device comprising an anode having electroluminescent phosphors and a cathode as above, wherein the cathode is a cathode array as above and is arranged to bombard said phosphors.

Preferably, said phosphors are arranged in groups of red, green and blue to form a colour display.

A field emission device as above may include anode driving means for energising said red, green and blue groups in turn.

A field emission device as above may further comprise an electrode of interdigitate or mesh form which is interposed between said phosphors and is arranged to be driven at a potential less than that at which said phosphors are driven, thereby to form potential wells around the phosphors in order to attract electrons towards said phosphors and compensate for any misalignment between cathode and anode.

The cathode may be provided with a further control grid over said gate electrode, and a driving means for so driving said control grid as to retard electrons emitted by the cathode.

Such a field emission device may further comprise means for providing a magnetic field normal to the emitter surface.

The first conducting layer, field emitting layer and second conducting layer may be patterned using low resolution means, as a whole or on a layer by layer basis. The same applies to the insulating layer and third conducting layer. The high resolution exposure step is preferably the only high resolution step required in the whole manufacturing method, and is such that the tolerance on location of the groups, with respect to intersections of the cathode and gate electrodes, is determined by the relatively large cathode and gate electrode dimensions (e.g. as tracks in rows and columns) rather than the much smaller emitter cell dimension. A first etch for the conducting layers is preferably chosen such that it does not attack the insulating or field emitting layers. A second etch for the insulating layers is preferably chosen such that it does not attack the conducting layers. Thus, the etching can be being carried out in sequential steps using the first and second etches alternately, such that each layer after etching forms a mask for the next layer to be etched, thereby providing self-alignment of the apertures in the layers.

In the context of this specification, the meaning of "low resolution means" and "high resolution means" is as follows. The high resolution means is a means capable of forming well-defined structures of the chosen emitter cell size. The low resolution means is a means capable of forming well-defined structures of the chosen size of cathode and gate electrodes but not of the smaller, chosen emitter cell size.

For example, the high resolution means may be a means capable of forming well-defined structures of a minimum size which is equal to or smaller than 50%, 40%, 30%, 20%, 10% or 5% of the minimum size of well-defined structure that can be formed by the low resolution means. The low resolution means may be a lithographic means that can form well-defined structures down to a minimum dimension of 100, 70, 50, 40 or 30 $\mu$m. The high resolution means may be a photo-etching means that can form well-defined structures down to a minimum dimension of 20 or 10 μm or less, and preferably down to a few μm across or less. As one example, cathode and gate tracks 100 μm across are formed by lithography means, and emitter cells 8 μm across are formed by photo-etching means.

For a better understanding of the invention, and to show how embodiments of the same may be carried into effect, reference will now be made, by way of example, to the accompanying diagrammatic drawings, in which:

FIG. 1*a* shows four pixels of an addressable array as would be used in a large area monochrome field emission display;

FIG. 1*b* shows an idealised emitter cell structure;

FIG. 1*c* illustrates the problems of realising such a structure using thick film fabrication techniques;

FIG. 1*d* shows how a near-ideal emitter cell structure may be fabricated using liquid bright gold and a glaze;

FIG. 1*e* shows how the structure in FIG. 1*d* may be improved by the use of a planarising layer between an insulator and final conducting layer;

Figure 7:
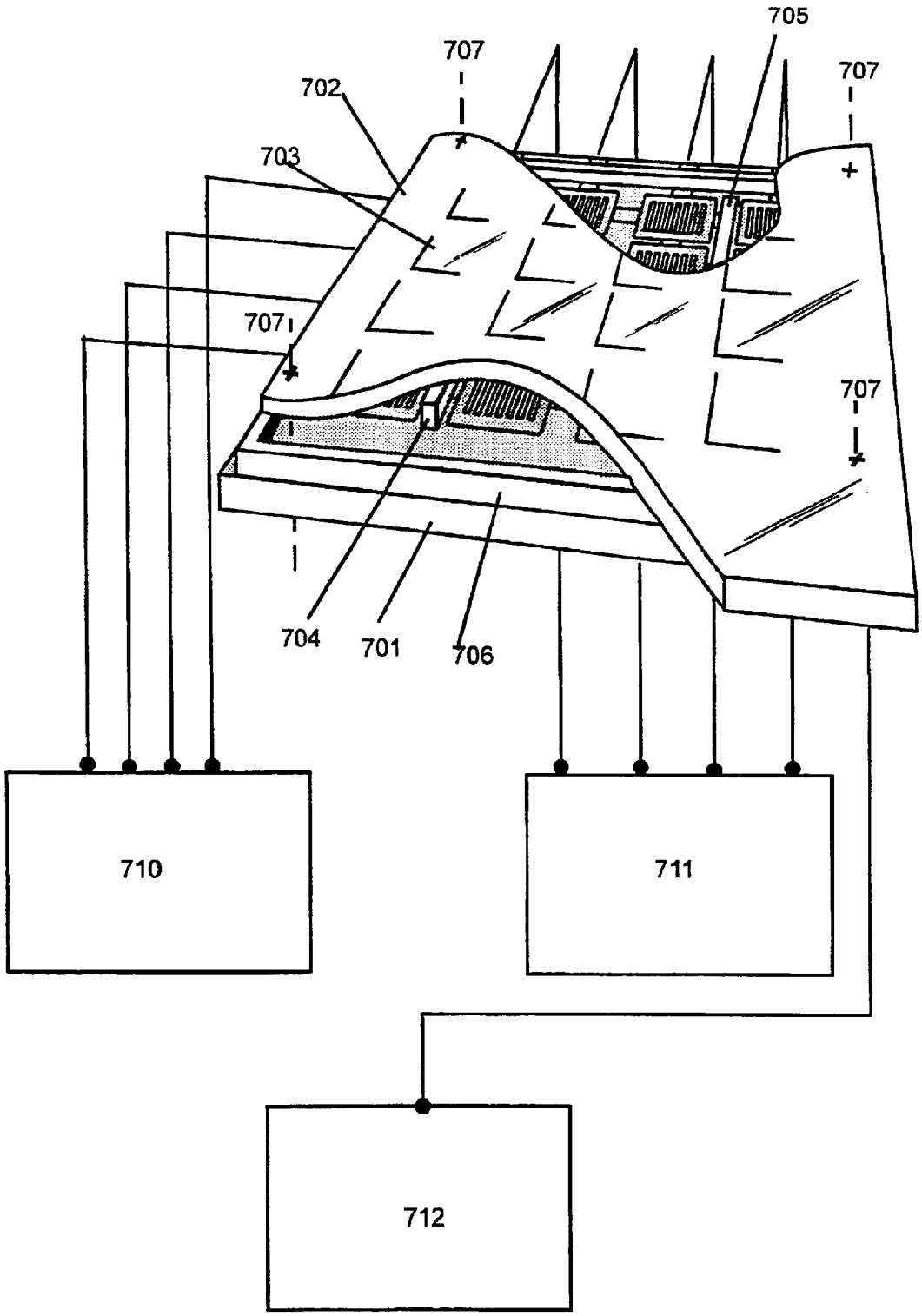
Figure 8A:
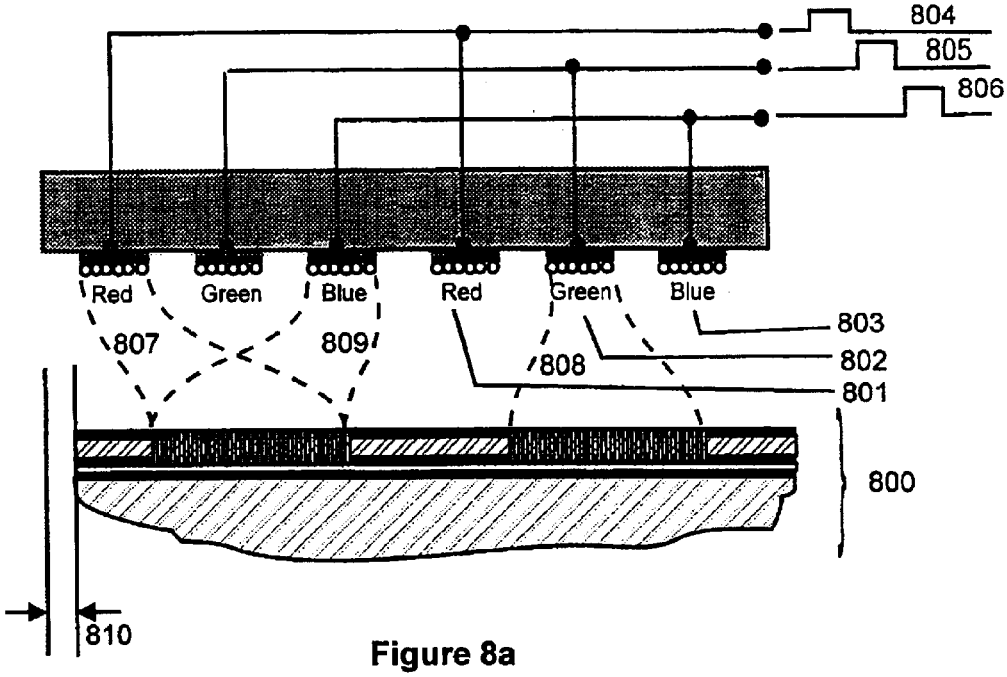
Figure 8B:
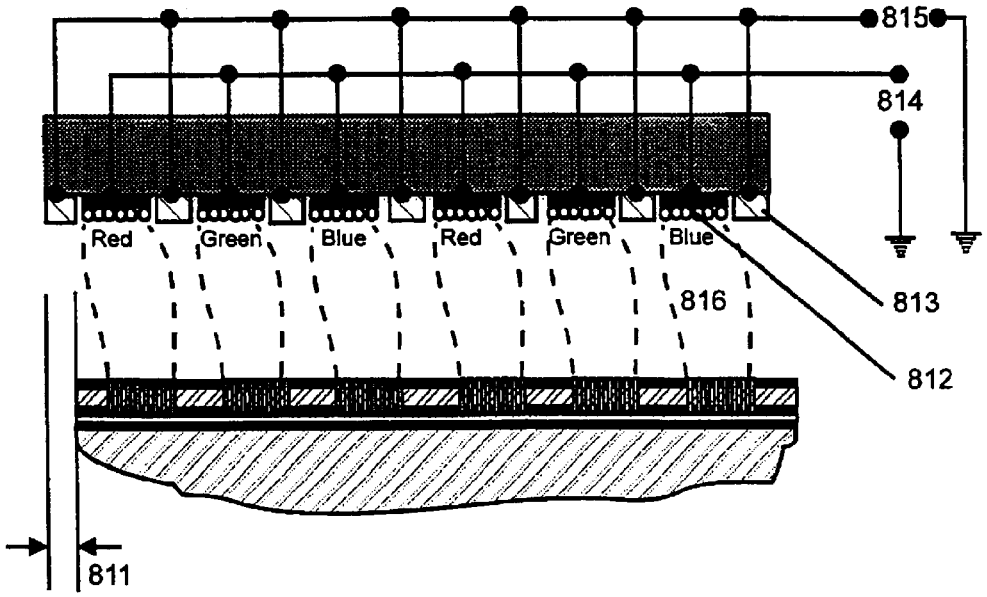
Figure 9:
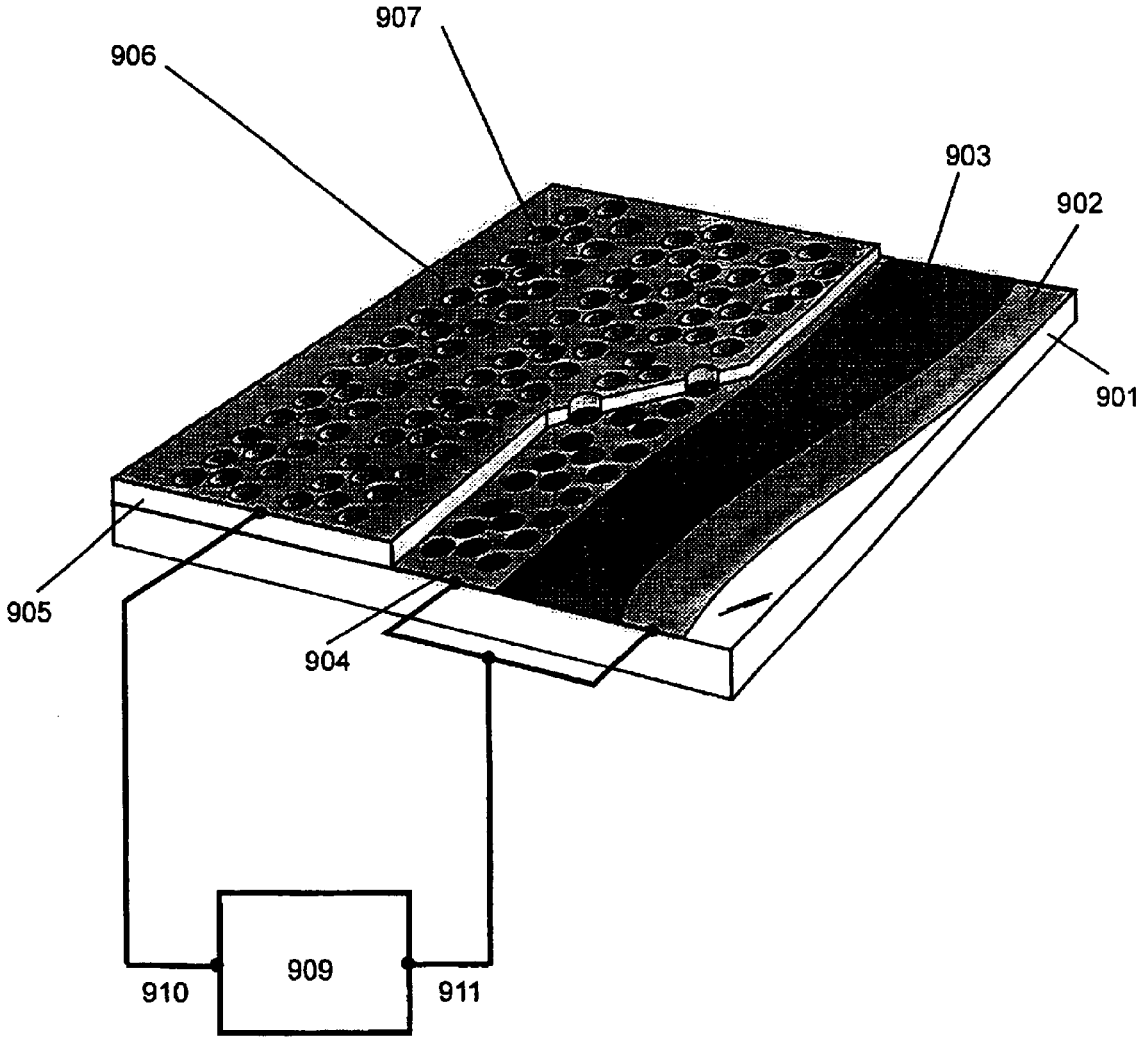

FIGS. 4(*a*) to (*f*) show steps in forming an addressable array using photolithography;

FIGS. 5(*a*) to (*d*) shows steps in forming an addressable array using a mixture of printing and photolithography;

FIGS. 6(*a*) and (*b*) show how focusing electrodes may be incorporated into devices;

FIG. 7 illustrates a complete display using methods and structures described herein;

FIGS. 8(*a*) and (*b*) show how misalignment between emitter cell groups and phosphor patches on an anode may be accommodated by special anode structures; and FIG. 9 is one example of a planar non-addressed emitter structure.

Embodiments of this invention may have many applications and will be described by way of the following examples. It should be understood that the following descriptions are only illustrative of certain embodiments of the invention. Various alternatives and modifications can devised by those skilled in the art.

In large field emitting displays the pixel dimensions are well within the capabilities of a number of low cost patterning techniques such as screen printing or photo-etching. For example printed circuits can now be made with well defined 75 μm tracks.

Figure 1A:
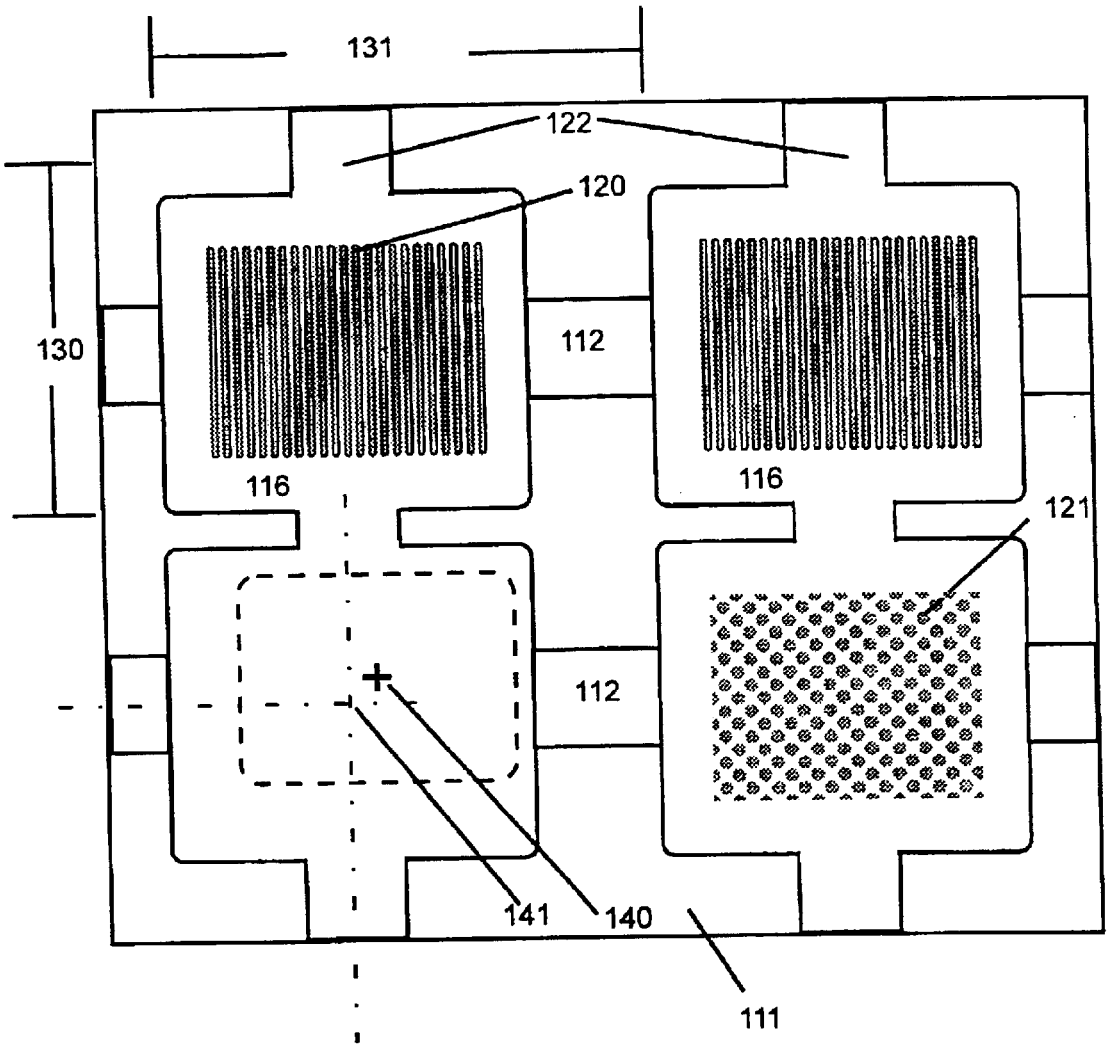
Figure 2:
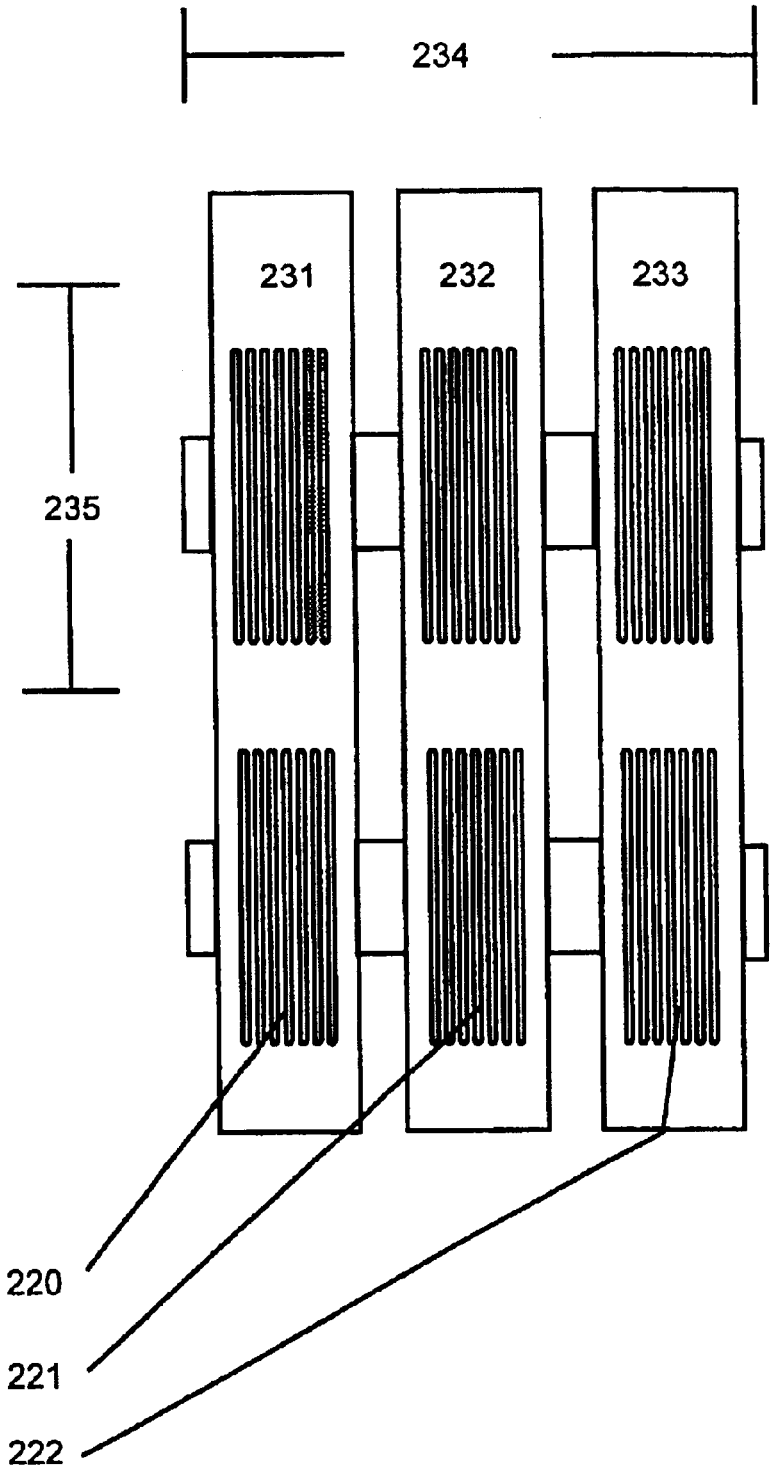
FIG. 2 shows a pixel arrangement in a colour display.

FIG. 1*a* shows four pixels in a hypothetical 16:9 HDTV display (monochrome for simplicity) with a diagonal dimension of one meter. Dimension 131 is 0.75 mm and dimension 130 is 0.50 mm. FIG. 2 shows two pixels of a similar colour display where dimensions 234 and 235 correspond with dimensions 131 and 130 in FIG. 1*a*. Columns 231,232 and 233 control current flow to phosphors in the three primary colours.

Referring again to FIG. 1*a*, it can be seen that cathode address rows 112 and gate address columns 122 are some tenths of a millimeter wide and capable of being formed by a range of printing and lithographic techniques. However, the emitter cell dimensions 120 are dictated by the transconductance required to achieve the desired control voltage. Because of the large number of channels, the drive electronics form a major cost element in any matrix addressed display, with higher voltage devices costing proportionally more. To achieve overall acceptable costs the drive voltages are preferably a few tens of volts.

Figure 1B:
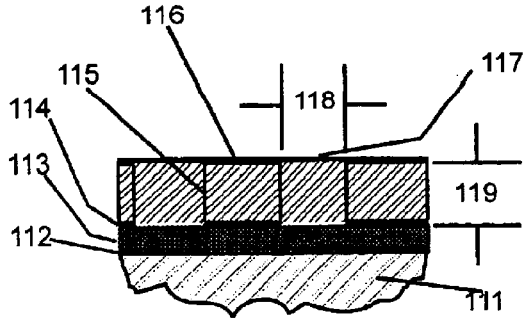

With reference to FIG. 1*a*, the emitter cells may be arrays of, for example, slotted 120 or circular forms 121. FIG. 1*b* shows a section across the narrow dimension of two such emitter cells. The structure is formed on an insulating substrate 111. The layers are as follows: cathode address rows 112; a field emitter material 113; shadow grid layer 114; gate (grid) insulator layer 115; grid address columns 116.

For electron optical reasons dimensions 118 and 119 must be comparable with each other. Such an arrangement also facilitates easy etching. Electrostatic modelling shows that for a 40V control voltage swing (negative-going on the rows and positive-going on the columns) dimension 118 is approximately 8 μm. For a 15V swing it reduces to approximately 4 μm.

Whilst these dimensions are small, it has occurred to us that, with a suitable self-aligning process, single exposures of resist patterns to create them fall within the regime of one to one contact exposure or one to one proximity exposure with collimated illumination. Suitable large area high intensity exposure systems, both with and without collimation, are manufactured for printed circuit board fabrication. It is only if multiple exposures are required that the very expensive and slow stepping and alignment equipment that characterises semiconductor manufacture is required. Furthermore, the location of each emitter group within the pixel region may be subject to a much larger tolerance (position 141 to 140) than that required if multiple mask steps were required to form the emitter cells.

To enable the above emitter patches to be aligned with the phosphor pattern on the anode during the assembly of the display panel, fiducial marks in known positions relative to the pattern of emitter cells may be photo-etched during the single high resolution mask stage.

Figure 1C:
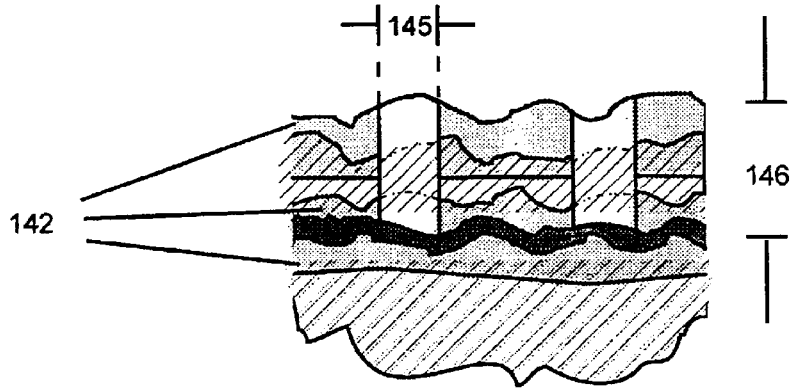

Given that the row and column structures are of a size capable of being screen printed one might be tempted to consider using standard electronic thick film circuit pastes to form the structures. FIG. 1*c* illustrates the problem with this approach where the goal is a structure as in FIG. 1*b* with dimension 118 of approximately 8 μm and dimension 119 approximately 5 μm. Conducting thick film pastes are made from metallic particles and a glass fritt in an appropriate vehicle. Minimum layer thicknesses are around 5 μm with roughness of ±1 to 2 μm. Proprietary insulating pastes have similar roughness.

It can be seen that, even without any undercutting that may occur during etching, the structures formed by standard thick film techniques are a very poor representation of the ideal structure in FIG. 1*b*. Not only would here be excessive variability from cell to cell but the extra depth 146 compared with the diameter 145 would be electronoptically unacceptable.

Inspection of FIG. 1*c* shows that excessive thickness and much of the irregularity in the layers is caused by those formed from conducting pastes 142. For this reason the vast majority of field emission device fabrication processes use vacuum or plasma deposited thin films that closely conform to the profile of the substrate. Their use within examples of this invention is not precluded. However, the deposition of such films requires expensive equipment especially at large substrate sizes and high throughputs: consequently maximum reductions in manufacturing cost may only be realised using deposition techniques that do not require vacuum systems.

In a number of unrelated industries, specularly reflecting films have been produced by chemical techniques, with a good example being the silvering on mirrors. In the architectural glass industry, infrared reflecting coatings, which were produced by sputter coating, are now made by the much lower cost in situ spray pyrolysis of tin oxide films directly onto hot float glass.

For many years, the pottery and glass industries have decorated their wares with bright metallic layers using a paint that contains organometallic compounds—the so called resinate or bright golds, palladiums and platinums. The metallic layer is formed by applying a paint and then firing the object in air at temperatures between 480° C. and 920° C. at which point the organometallic compound decomposes to yield pure metal films 0.1 to 0.2 $\mu$m thick. Traces of metals such as rhodium and chromium are added to control morphology and assist in adhesion. Currently most of the products and development activity concentrate on the decorative properties of the films. However, the technology is well established. Although little (or not) used, or known of, in the art today, such techniques have been used in the past by the electron tube industry. For example Fred Rosebury's classic text "Handbook of Electron Tube and Vacuum Techniques" originally published in 1964 (Reprinted by *American Institute of Physics—ISBN* 1-56396-121-0) gives a recipe for liquid bright platinum. More recently Koroda (U.S. Pat. No. 4,098,939) describes their use for the electrodes in a vacuum fluorescent display.

In critical electronic applications of liquid bright golds, care is required to avoid a bloom of sodium sulphate forming on the surface of the films. The bloom is believed to be formed by sodium compounds reacting with sulphur compounds (sulphur dioxide and/or trioxide) from the decomposition of the sulphur based gold organometallic compounds. Such bloom may be minimised or eliminated by either the use of either a low sodium glass—such as borosilicate—or by the use of coatings on sodalime glass. One suitable coating is silica deposited from a vapour phase precursor onto hot float glass. Glass treated in this way is manufactured by Pilkington under the trade name Permabloc.

Accordingly, by replacing the thick film conducting pastes with a liquid bright metal, preferably gold, one of the obstacles to a low-cost low-voltage field emission display can be overcome. The coating formulation may be deposited by spraying, spinning, roller coating, screen printing, wire roll coating or other suitable technique and then simply fired in air. In the case of some of these techniques, for example screen printing, the formulation may be directly applied in the conducting track pattern, thus eliminating a photolithography stage.

Clearly there are other non-vacuum techniques for producing metal films. However, we are unaware of the use of any such techniques in the art of field emission devices. In part this must be due to the use of established semiconductor fabrication processes by workers who have migrated from that art. Where deviations from established techniques have taken place they are slight. For example DeMercurio et al (U.S. Pat. No. 5,458,520) uses electroplating within a gate microtip structure but only then to thicken up layers and close apertures, the initial metal layers being deposited by vacuum means.

An alternative method of forming the conducting elements is to use electroless plating with a photo-activated catalyst. There are other non-vacuum methods.

The insulating pastes used in traditional thick film technology may be replaced with a glass formulation which can be taken well past its melting point into a region where it has low viscosity and allowed to flow to a smooth film (as in a glaze) to form uniform (or near uniform) thickness gate-cathode insulator layers.

An alternative method of forming the insulating layer is by using liquid chemical precursors such as sol gels, aerogels or polysiloxanes. Once the layer is formed it is heated to decompose the precursor to form an inorganic compound such as an oxide (e.g. Silica), a ceramic or a glass.

Figure 1D:
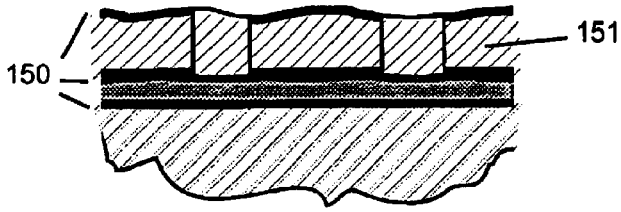

FIG. 1*d* illustrates that by bringing together a low cost method of forming smooth metal layers 150 derived from a liquid bright metal, electroless plating or other suitable process and the insulator layer 151 formed from a complementary low-cost process, structures close to the ideal shown in FIG. 1*b* may be realised.

Figure 1E:
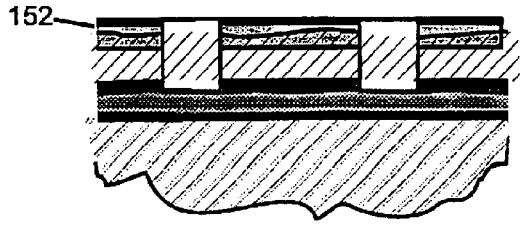

If required, (see FIG. 1*e*) this arrangement may be further improved by using a planarising layer 152 such as one of the spin-on glass formulations widely used in the semiconductor industry.

Example I

Figure 3:
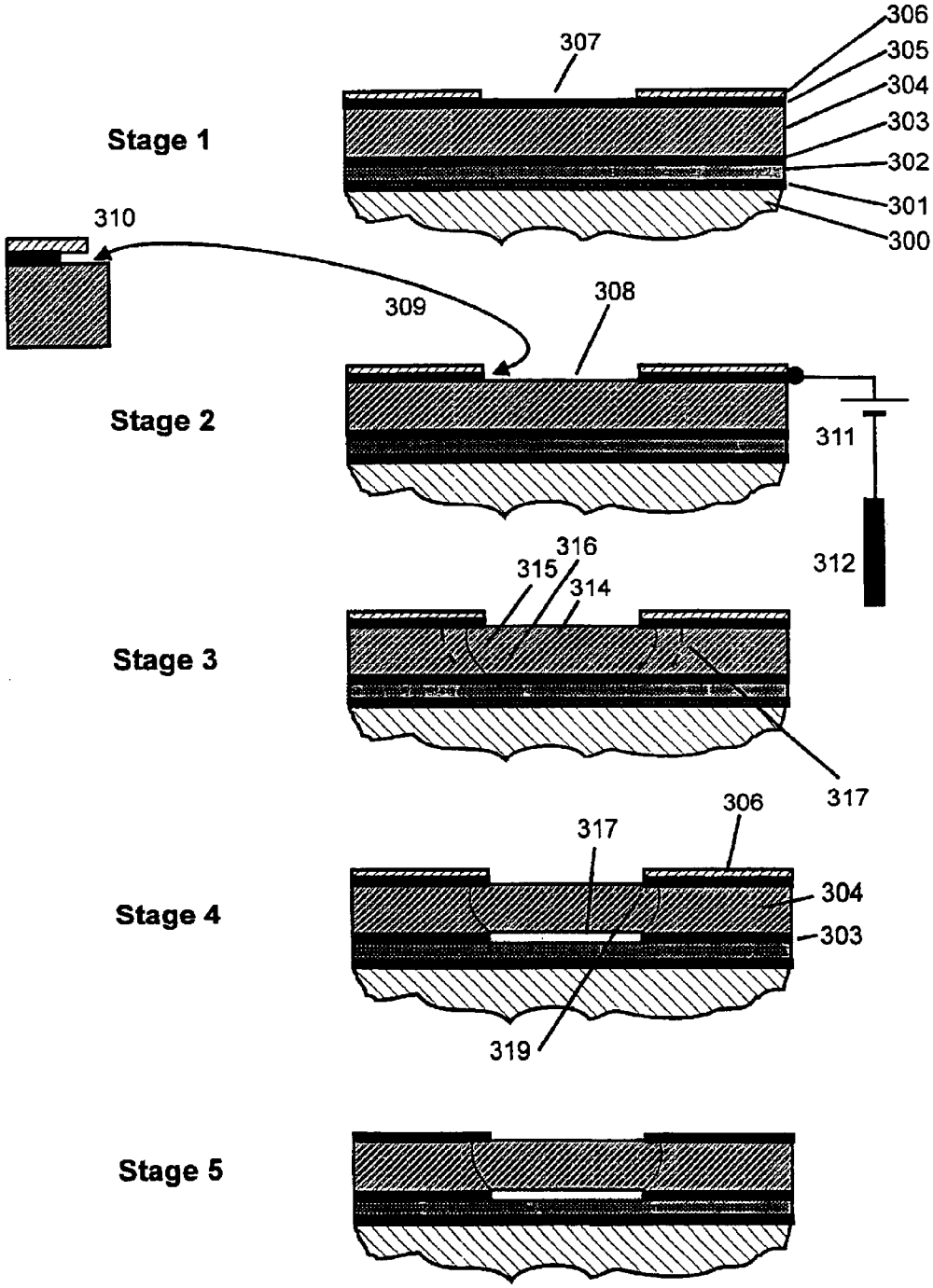
FIG. 3 shows etch steps in forming an emitting cell.

Referring now to FIG. 3, we will describe an illustrative example. In this, emitter cells may be formed in gold/low melting point glass laminated structures on a glass substrate using wet etch processes. Naturally, dry etch processes can be used but these increase manufacturing cost.

One advantage of this combination of materials is that because low melting point glasses and gold have coefficients of thermal expansion close to that of soda lime glass, a reasonably strain free structure is produced.

Prior to stage 1, first conductive layer 301, field emitter layer 302, second conductive layer 303, insulator 304 and third, gate conductor layer 305 have been formed on substrate 300. Thus, stage 1 joins the process at a point at which all of the track patterns have been formed by low resolution patterning techniques and an appropriate photoresist layer 306 has been exposed by high resolution means and developed with a pattern of grid cell apertures to expose these regions 307 of the laminate to various etch stages. A resist or lacquer will also have been applied to protect the reverse side and edges of the glass substrate.

The requirement is for two etch solutions. One solution must remove gold but not attack glass and the other remove glass but not attack gold. In this way, self-alignment of the cell structure is obtained, as will become apparent from the following description.

A suitable etch for glass that does not attack gold is hydrofluoric acid.

With etches for gold there are more options. Aqua regia, the classic gold etch, is an unpleasant material and, being strongly oxidising, may attack photoresists. Two practical formulations are a solution of iodine in potassium iodide or a solution of bromine in potassium bromide (Bahl—U.S. Pat. No. 4,190,489).

Now, returning to FIG. 3, in stage 2 the structure from stage 1 is exposed to the gold etch solution. It is known by those skilled in the art that there is a tendency for the gold to etch back under the resist as shown at 309, 310. Whilst an undersize aperture may be used to compensate for this effect during the etching of the top gold layer 305, this strategy cannot be used for layer 303. It is reported in the art (U.S. Pat. No. 4,131,525) that this undercutting is caused by electrochemical effects and can be suppressed by applying a bias voltage 311 to the gold layer relative to a platinum electrode 312 immersed in the etch solution. Once the upper gold layer has been removed to expose the glass surface 308, the assembly is rinsed to remove any active gold etch. There will be a rinsing stage between each step but, for the sake of brevity, the rest of these are not described.

In stage 3, hydrofluoric acid is used to remove the glass gate-cathode insulating layer 304. By sloping the insulator away from the exiting electron beam, and thus reducing charging effects, any undercut 315 that occurs has a beneficial effect on the electronic performance of the emitting cell but creates some new problems at stage 4. However, it is known that the voltage-current characteristic of the structure is dominated by the size of the aperture 314. Furthermore, the arrangement of electrodes focuses the electrons as they leave the cathode, making it tolerant to an increase in the diameter of the emitter size over its nominal value which may have been caused by slight over-etching 317. In all cases the gold film 303 protects the emitter from any attack by the hydrofluoric acid and acts as an etch stop. This is particularly important with a glass-based emitter such as those described in Tuck et al (GB Patent 2304989).

In stage 4 the gold etch is used to remove the layer 303, with the glass layer 304 and the resist layer 306 protecting the upper gold track 305. Erosion of the upper gold layer if it overhangs the cell 319 may be compensated for in the original size of the aperture in the resist. Again, biasing of the gold layer may be used to prevent undercutting.

In stage 5 the resist is removed to leave the completed structure.

Example II

Referring now to the various parts of FIG. 4, in which views on the left hand side are cutaway plan views and views on the right hand side are sectional views, it will be seen how the above self-aligning technique may be combined with low resolution optical lithography to produce the cathode plane of a matrix addressable field emission display. All drawings are simplified and relate to a single pixel and its associated connecting tracks.

Figure 4A:
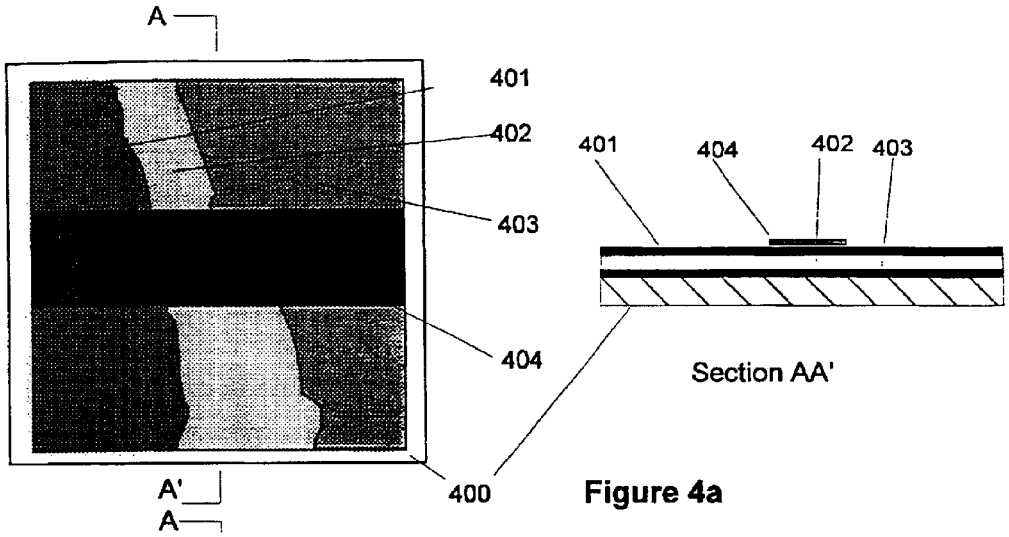
Figure 4B:
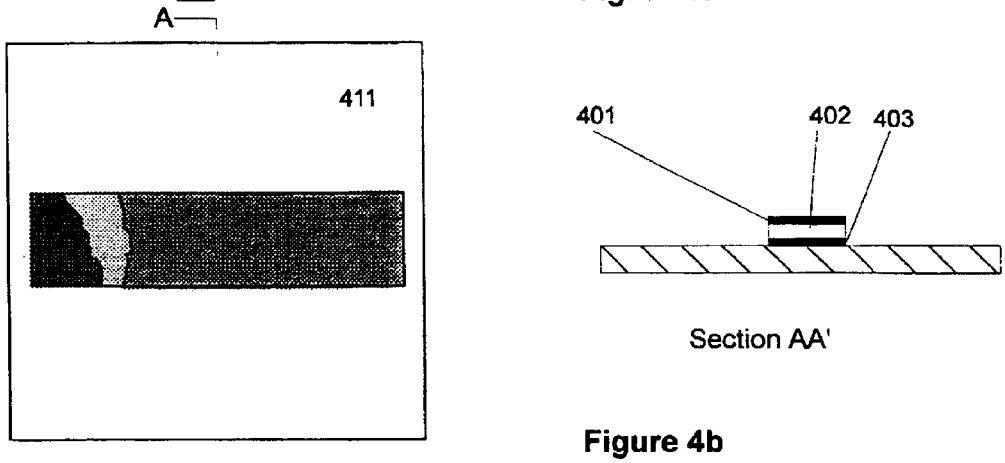

FIG. 4*a* shows a metal/glass-based field emitter/metal sandwich 403/402/401 deposited on a substrate 400 with an exposed and developed resist pattern defining the cathode address rows 404. For illustrative purposes the metal films are formed by a liquid bright gold process and emitter film from a fused glass-based layer (GB 2304989). The precursor layers may have been deposited by spraying, spinning, silk screening, wire roll coating or some other coating technique. After coating with the formulations, each of the three layers will have been fired in air to form the final composition. In production this may be conveniently performed in tunnel furnaces.

Using the etches previously described, the gold and glass-based emitter layers are sequentially and selectively removed. Finally the resist layer is removed to form the structure 411 in FIG. 4*b*.

Figure 4C:
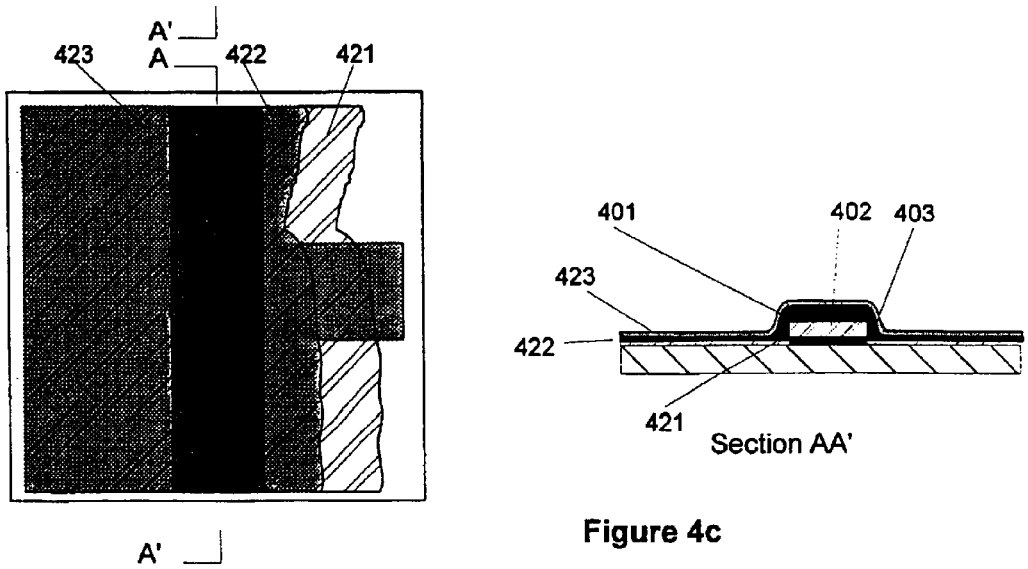
Figure 4D:
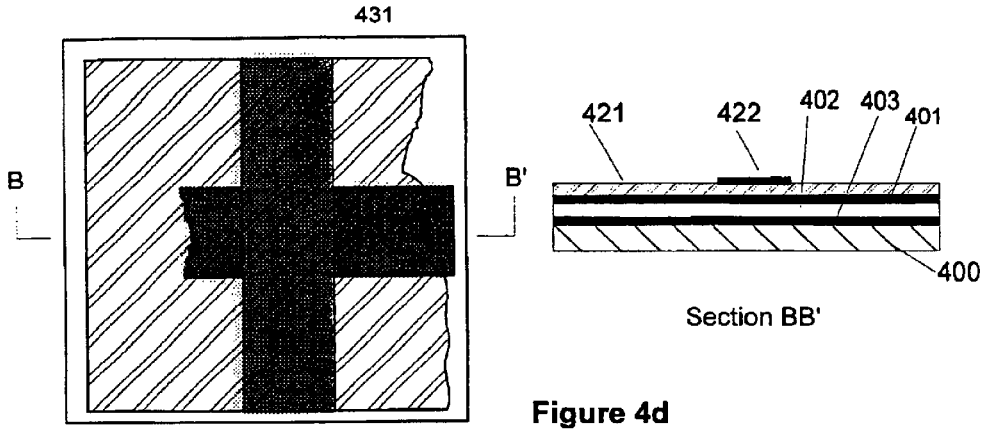

FIG. 4*c* shows the structure after it has been over-coated using the same techniques with a fusible glass insulating layer 421 and a gold gate layer 422. Again firing will have taken place in air. A resist pattern is formed to define a gate address column 423. A gold etch is used to remove the unwanted material. Finally the resist is stripped off to form the structure 431 in FIG. 4*d*. The insulator layer 421 is left intact since the chemicals used to remove it would also attack the glass substrate.

Figure 4E:
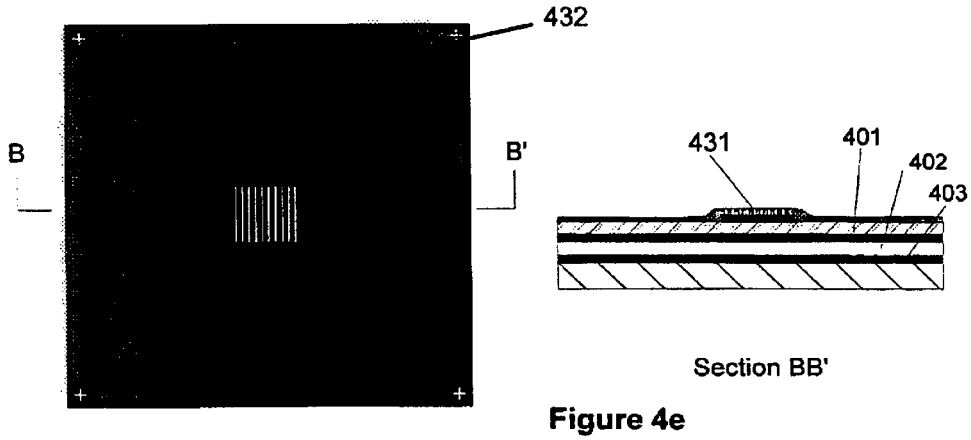

A further layer of resist is now applied, patterned and developed using a single high resolution exposure system as previously described to form the emitter cell pattern and fiducial marks 432 shown in FIG. 4*e*.

Figure 4F:
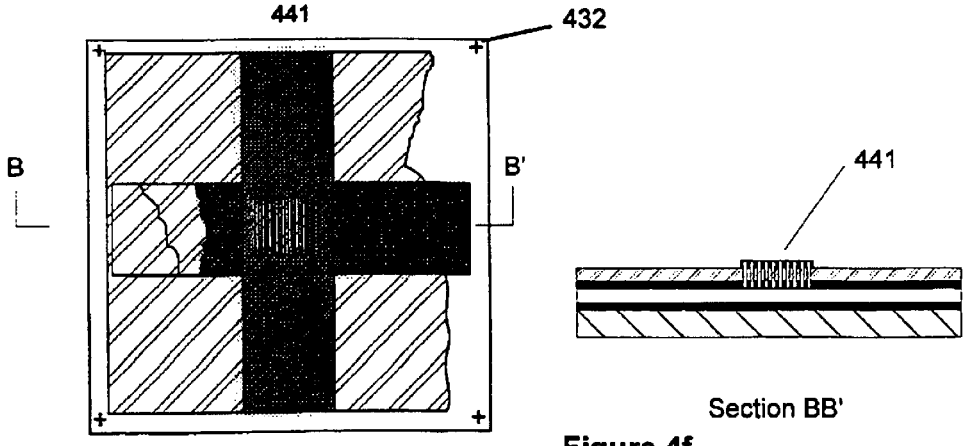

The emitter cell etching sequence illustrated in FIG. 3 previously described as Example I is now used to form the completed structure with emitter cells 441 shown in FIG. 4*f*.

Example III

Referring now to the various parts of FIG. 5, it can be seen how the above self-aligned technique may be combined with low resolution direct printing techniques to produce the cathode plane of a matrix addressable field emission display. All drawings are simplified and relate to a single pixel and its associated connecting tracks. For ease of comparison with Example II the liquid bright gold/low melting point glass is used. However, photoactivated electroless nickel plating could be used to replace the gold, with nitric acid or hydrochloric acid/ferric chloride etches. In some cases a reducing atmosphere may be used during firing operations to reduce oxidation of the nickel.

Figure 5A:
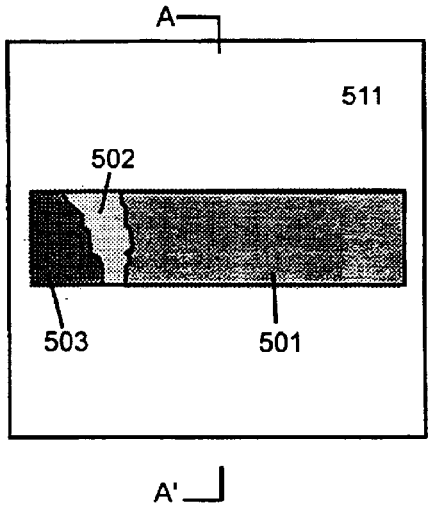
Figure 5A:
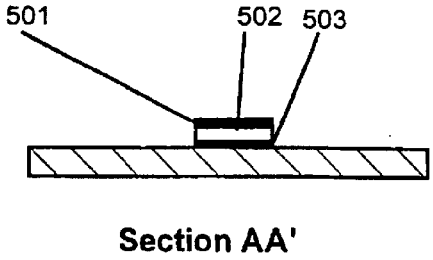

Returning now to FIG. 5 we continue with the example based upon liquid bright gold and low melting point glass. FIG. 5*a* shows substrate 511, gold 503, glass-based emitter 502, gold 501 structure formed in the same way as Example II, but in this case the precursor formulations are selectively applied, for example by screen printing, to form the desired track pattern.

Figure 5B:
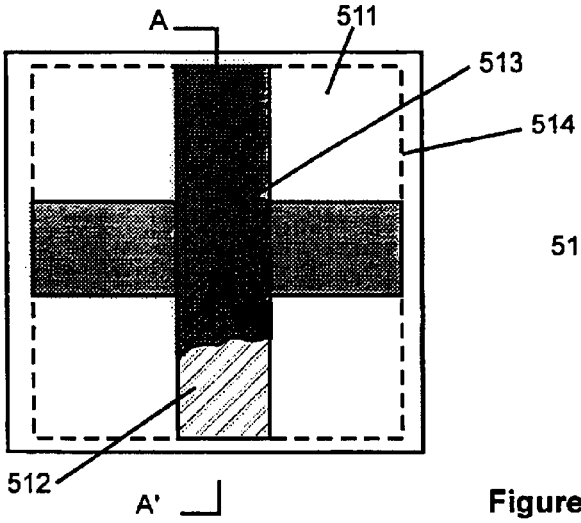
Figure 5B:
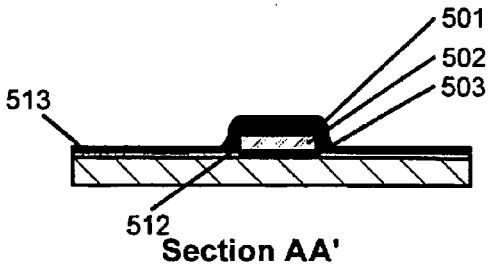

FIG. 5*b* shows a fusible glass insulator 512 and gold track 513 formed as in Example II again in the desired track pattern. If desired the insulator layer may cover the entire surface 514.

Figure 5C:
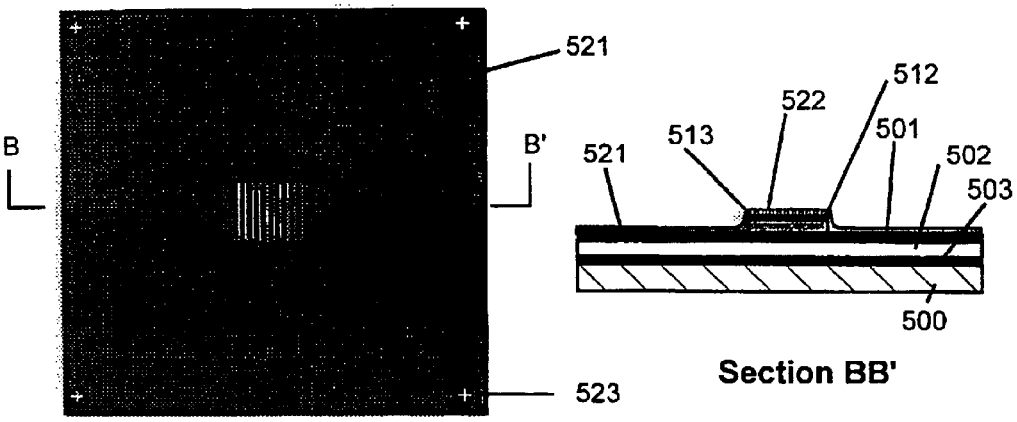

A layer of resist is now applied, patterned and developed using a single high resolution exposure system, as previously described, to form the emitter cell pattern 522 and fiducial marks 523 shown in FIG. 5*c*.

Figure 5D:
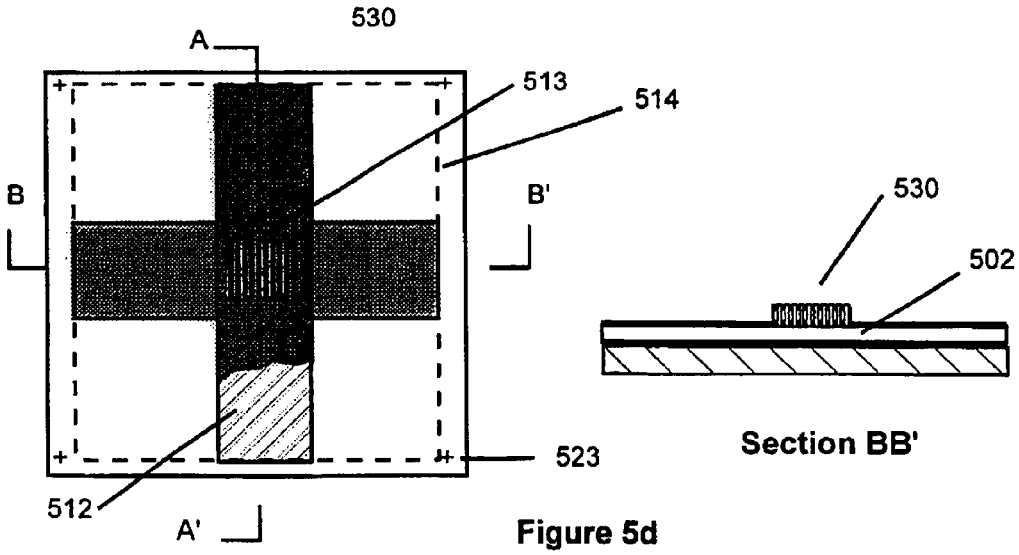

The emitter cell etching sequence illustrated in FIG. 3, previously described as Example I, is now used to form the completed structure with emitter cells 530 shown in FIG. 5*d*.

A person skilled in the art will understand from the above teachings the significant savings in manufacturing costs that can be realised by a method which utilises a sequence of in-air processes and low-cost lithography, rather than semiconductor fabrication techniques, to form a complete field emission display cathode plane.

Figure 6A:
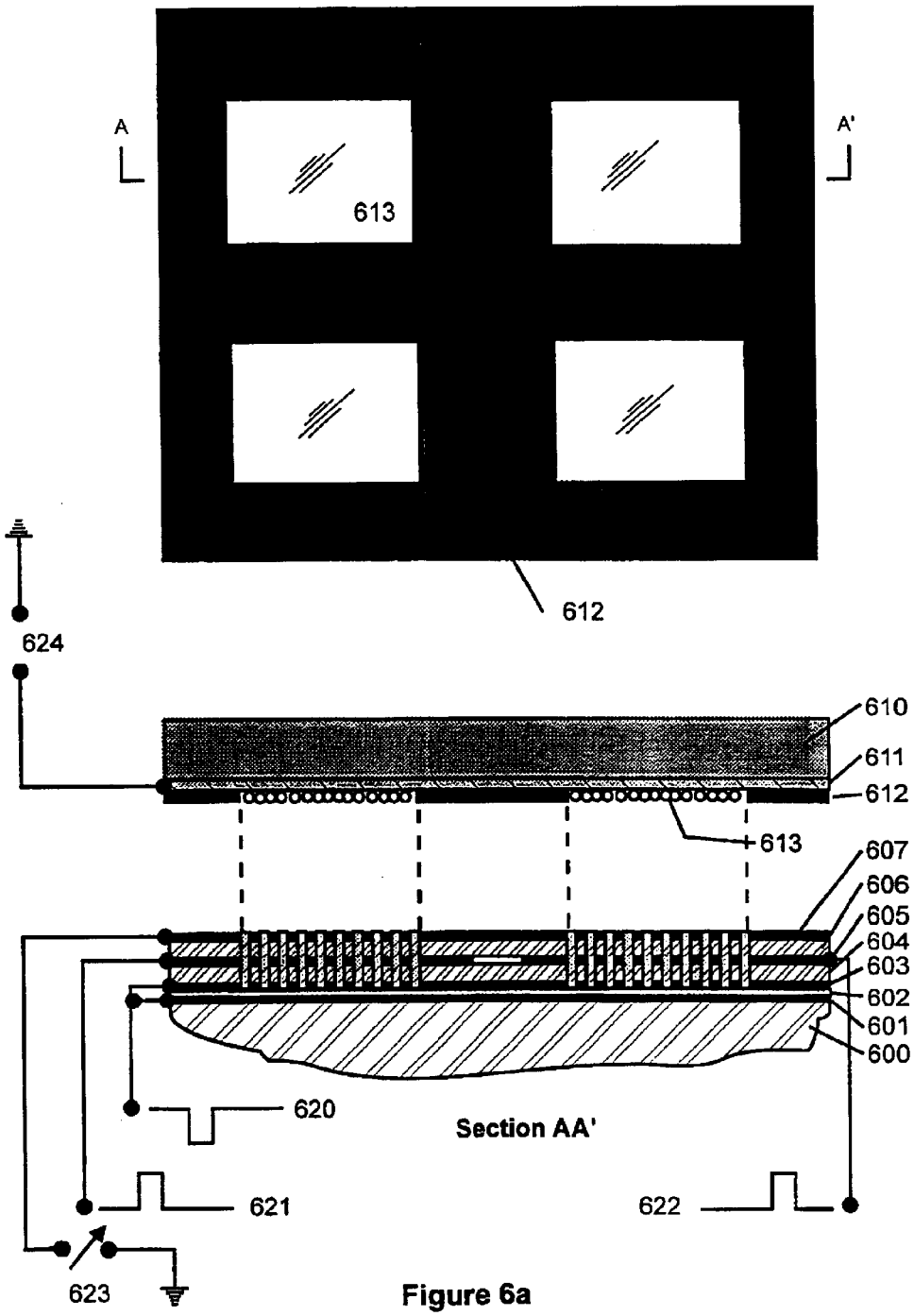

The use of a focus grid above a gated emitter to focus the electron beam(s) has been used and was initially described by Tuck (U.S. Pat. No. 4,145,635). Later essentially the same arrangement was utilised in a field emitting display by Palevsky et al (U.S. Pat. No. 5,543,691). Such a structure may be fabricated in embodiments of this invention by overlaying a further layer of insulator and a further layer of metal onto the structures of FIG. 4*d* and 5*b*. Said layers may be continuous or patterned to reduce inter-track capacitance or to fulfil some other function. The emitting cells with their associated focus electrodes are then etched using the techniques previously described in Example I or, if different material systems are used, their appropriate etch systems. FIG. 6*a* shows such a completed structure in which a substrate 600 has upon it: a cathode address layer 601; a broad area emitting layer 602; a shadow grid layer 603; a gate (grid) insulator layer 604; a control gate (grid) layer 605; a focus grid insulator layer 606 and a focus grid 607. The anode plate 610 has upon it a transparent conducting layer 611 (for example indium tin oxide) and conducting black matrix 612 to mask the space between the cathodoluminescent phosphor patches 613. A DC potential 624 positive with respect to the ground is applied to the conducting layer 611 to accelerate the electrons from the cathode plane to energies sufficient to cause cathodoluminescence from the phosphor 613.

At the cathode plane a negative voltage 620 with respect to ground selects a cathode row, and positive voltages 621 and 622 with respect to ground modulate the current flow from the cathode. Various drive schemes may be used ranging from analogue voltage control to constant voltage pulse-width modulation. A variable voltage 623 (generally negative with respect to the control gate) forms an electron lens and focuses the beamlets.

Figure 6B:
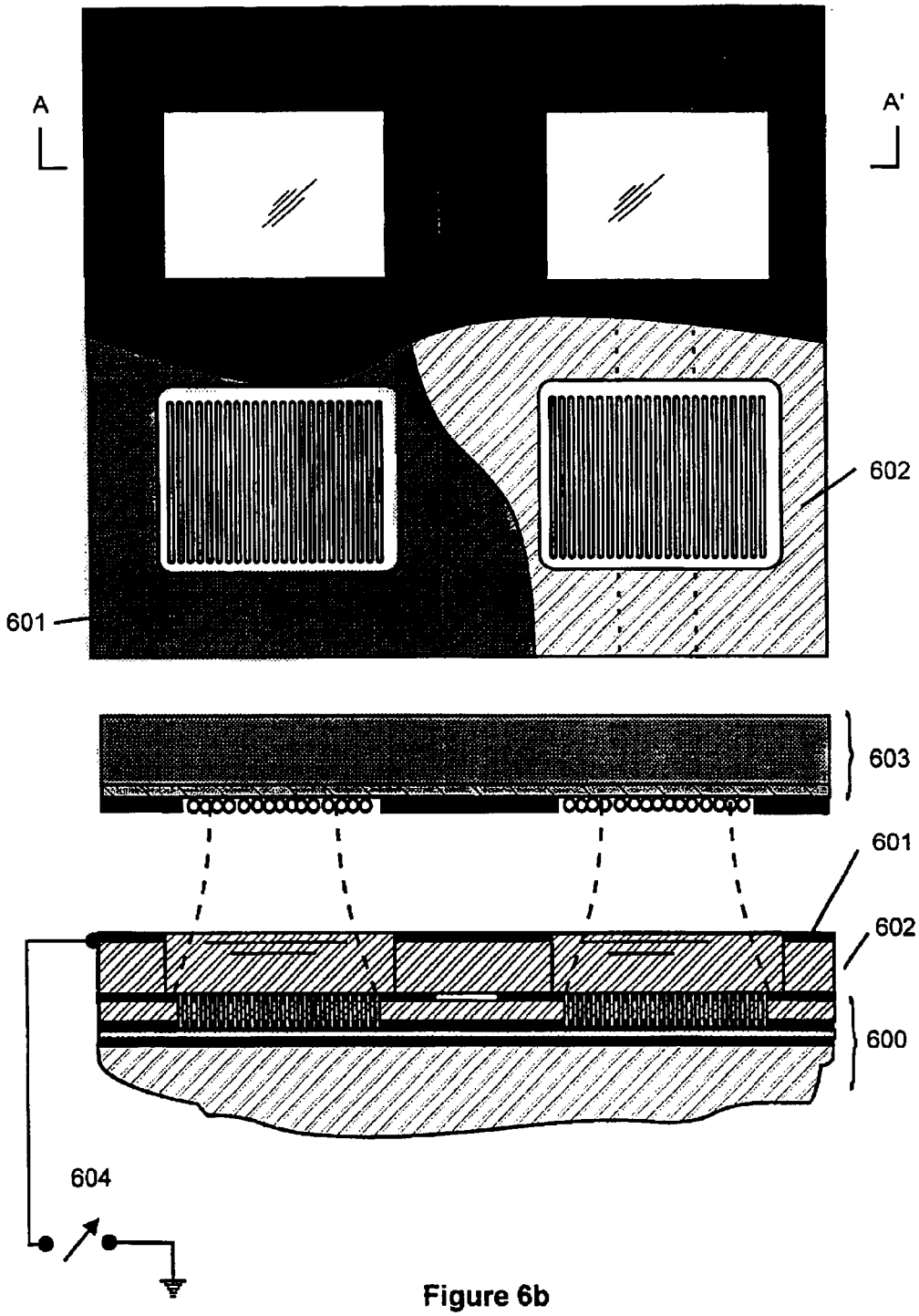

Alternatively a much coarser focus mesh system, analogous to that described by Palevsky (U.S. Pat. No. 5,543,691), may be fabricated by directly printing a layer of insulator and conductor onto a completed gated array. Such an arrangement is shown in FIG. 6*b* where insulator and focus grid layers are overlaid onto a gated structure 600 identical in structure to that described earlier and illustrated in FIG. 1*a*. Again a variable potential 604 on electrode 601 is used to focus the electron beams to strike the anode plane 603.

Moving on now to FIG. 7 it can be seen how a complete field emission display may be realised that utilises the methods and structures herein described.

A cathode plane formed as described earlier 701, with or without an integral focusing grid, is joined by an hermetic seal 706 to an anode plane 702. Said anode plane 702 has upon it spacers, a conducting layer, black matrix and phosphor patches in a pixel pattern 703 as previously described. To resist the pressure of the atmosphere following evacuation spacers 704 are disposed between the pixelated structure. The spacers may be of glass, ceramic or other suitable material. The hermetic seal 706 may include a pre-formed frame and may be cemented to the cathode and anode plates with a glass fritt. During the sealing process the fiducial marks 707 (formed as previously described) are used to align the pixelated structures of the cathode and anode planes. Gettering means may be incorporated into the assembly to pump residual gasses. Some ideal locations for such getters are described by Tuck et al (GB Patent 2,306,246). Evacuation and bakeout of the completed structure may be via a pumping tube and oven (not shown) or by completing the sealing process in a vacuum furnace with appropriate manipulation.

The completed display is electrically driven by a cathode addressing module 710; a column address module 711 and an anode voltage power supply 712. In the event that a focus grid is used an additional focus grid supply (not shown) is provided. Additional anode switching and focusing supplies (not shown) as later described may also be provided.

A method of forming fiducial marks to assist in the alignment of the pixelated structures on the cathode and anode planes has been described earlier and illustrated in the various parts of FIGS. 4 and 5. However, some residual misalignment may still occur. This is particularly troublesome in colour displays where misalignment in the direction parallel with the cathode address lines 810 may result in electrons striking the wrong phosphor patch with an associated loss in colour purity.

FIG. 8*a* illustrates one method of making a display more tolerant of misalignment. In this arrangement the conducting layer on the anode plane is in three interdigitated segments 801, 802 and 803. Each segment has phosphors of one primary colour. Said segments are driven by independent power supplies 804, 805 and 806, each of which is switched on for one third of a frame. Electrons from the cathode plane 800 are now sequentially attracted to each colour phosphor in turn and follow trajectories 807, 808 and 809. Since the other two colour phosphors are not energised they cannot luminesce and the effects of misalignment are avoided. However, because of electrical breakdown between segments, this approach can only be used in low anode voltage systems. Such an approach has been described for tip-based displays by Clerc (U.S. Pat. No. 5,225,820).

FIG. 8*b* illustrates an alternative arrangement in which the display is rendered tolerant of misalignment 811 by forming focusing electrons to each phosphor patch 812 by means of an electrode of interdigitate or mesh form 813 at a less positive potential 815 than the main anode supply 814. Each phosphor patch now sits within a potential well that is sufficiently attractive to electrons 816 to compensate for modest misalignment of the pixelated structures on the cathode and anode. Such an approach has been described for tip-based displays by Tsai et al (U.S. Pat. No. 5,508,584).

Whilst some examples of the invention have been described above in the context of a matrix addressed flat panel display, the methods and structures disclosed herein may be utilised across a wide variety of devices. In particular, a non-addressed or partially addressed electron source may be constructed and incorporated into other electron devices or displays. A focus grid structure such as previously described may be used to either focus or retard emitted electrons. If used in the retarding mode, the arrangement can, especially when combined with a magnetic field normal to the emitter surface, provide a source of low energy electrons that can substitute for a thermionic cathode in some devices.

FIG. 9 shows one example of a planar non-addressed emitter structure that may be used as an electron source in a wide variety of applications.

On an electrically insulating substrate 901 there is provided a conducting layer 902 and a broad-area field emitting layer 903. A perforated focus grid layer 904 serves to guide electrons though emitter cells 907 which are formed by apertures in insulating layer 905 and gate layer 906. Such a structure may be fabricated by any of the appropriate methods described in this specification.

In this non-addressed application the electrically insulating substrate may be replaced by an electrically conducting one (e.g. a metal) and the functions of substrate 901 and conducting layer 902 combined. A metal substrate enables welding and many other standard engineering joining techniques to be used.

The current from such a structure is controlled as follows. A device incorporating the illustrated emitter structure is used in conjunction with an electron accelerating anode (not shown in FIG. 9) to collect the emitted current. A DC or pulsed power supply 909 connected to points 910 and 911 is adjusted such that in the "on" condition, a suitable positive extraction field, typically ~10 MV $m^{-1}$ (10 V/$\mu$m), is applied to the areas of broad-area field emitter exposed at the base of the emitter cells 907 whereas, in the "off" condition, the applied electric field is less than the threshold value for field emission. Naturally, the applied potential may be varied to produce a pulsed or AC emission current.

Devices that can utilise this invention may include: field electron emission and other display panels; high power pulse devices such as electron MASERS and gyrotrons; crossed-field microwave tubes such as CFAs; linear beam tubes such as klystrons; flash x-ray tubes; triggered spark gaps and related devices; broad area x-ray sources for sterilisation; vacuum gauges; ion thrusters for space vehicles; lamps; particle accelerators; ozonisers; and plasma reactors.

In this specification, the verb "comprise" has its normal dictionary meaning, to denote non-exclusive inclusion. That is, use of the word "comprise" (or any of its derivatives) to include one feature or more, does not exclude the possibility of also including further features.

What is claimed is:

1. A method of manufacturing a field electron emission cathode having at least one cathode electrode which comprises a field emitting layer (302) on a first conducting layer (301), and at least one gate electrode which overlies said cathode electrode and comprises an insulating layer (304) and a gate conducting layer (305), characterised in that said method comprises the steps of:

a. depositing on an insulating substrate (300) to form by low resolution means, a sequence of said first conducting layer (301), said field emitting layer (302) and an etch-stop layer (303) to form said at least one cathode electrode;

b. depositing on said cathode electrode to form by low resolution means, a sequence of said insulating layer (304) and gate conducting layer (305), to form said at least one gate electrode;

c. coating the structure thus formed with a photoresist layer (306);

d. exposing said photoresist layer (306) by high resolution means to form at least one group of emitting cells, the or each said group being located in an area of overlap between one said cathode electrode and one said gate electrode;

e. etching sequentially said gate conducting layer (304), said insulating layer (304) and said etch-stop layer (303) to expose said field emitting layer (302) in said cells, such that said etch-stop layer (303) protects said field emitting layer (302) from etchant during etching of said insulating layer (304); and f. removing remaining areas of said photoresist layer (306).

2. A method according to claim 1, wherein said cathode is a cathode array, said cathode electrode and said gate electrode comprise respectively cathode addressing tracks and gate addressing tracks, which tracks are arranged in addressable rows and columns, and step d. includes forming a pattern of said groups of emitting cells.

3. A method according to claim 2, wherein at least one of or all of said cathode addressing tracks address(es) a plurality of rows or columns of cells.

4. A method according to claim 2, wherein said steps of exposing and etching include the formation of fiducial marks (432) on the cathode array, to facilitate the subsequent alignment of the array with an anode or other component after manufacture of the array.

5. method according to claim 1, 2, 3 or 4, comprising the step of forming at least one of said conducting layers (301, 305) by application of a liquid bright metal or by electroless plating.

6. A method according to claim 1, 2, 3 or 4, comprising the step of forming at least one of said conducting layers (301, 305) by a means other than vacuum evaporation or sputtering.

7. A method according to claim 1, 2, 3 or 4, wherein said field emitting layer (302) comprises a layer of broad area field emitter material.

8. A method according to claim 1, 2, 3 or 4, comprising the further steps of depositing sequentially a second insulating layer (606) and focus conducting layer (607) onto the cathode after completion of steps a. to f., to form a focus grid.

9. A method according to claim 1, 2, 3 or 4, wherein said etch-stop layer (303) is a conducting layer.

10. A method according to claim 1, 2, 3 or 4, wherein said etch-stop layer (303) is a metal layer.

* * * * *